United States Patent [19]

Grillet

[11] 4,216,724

[45] Aug. 12, 1980

[54] STOP DEVICE FOR STOPPING A WHEELED VEHICLE

[75] Inventor: Charles Grillet, Asnieres, France

[73] Assignee: Cgee Alsthom, Levallois Perret, France

[21] Appl. No.: 951,204

[22] Filed: Oct. 13, 1978

[30] Foreign Application Priority Data

Oct. 28, 1977 [FR] France ..... 77 32637

[51] Int. Cl.[2] ..... B61K 7/20

[52] U.S. Cl. ..... 104/258; 104/254; 188/36

[58] Field of Search ..... 104/249, 254, 257, 258, 104/259, 260; 188/32, 36; 74/96

[56] References Cited

U.S. PATENT DOCUMENTS

| | | | |
|---|---|---|---|
| 441,539 | 11/1890 | Deets | 104/257 |
| 2,038,141 | 4/1936 | Stone | 104/257 |
| 2,077,339 | 4/1937 | Livingston | 104/257 X |
| 2,486,332 | 10/1949 | Showers | 104/259 |

FOREIGN PATENT DOCUMENTS

| | | | |
|---|---|---|---|
| 73166 | 1/1894 | Fed. Rep. of Germany | 104/260 |
| 756670 | 12/1933 | France | 104/257 |
| 717539 | 10/1954 | United Kingdom | 74/96 |

*Primary Examiner*—Randolph A. Reese

*Attorney, Agent, or Firm*—Sughrue, Rothwell, Mion, Zinn and Macpeak

[57] ABSTRACT

A device for stopping a wheeled vehicle which runs on a guide rail, comprises a scotch block connected to the rail, against which the front wheel of the vehicle can strike. The scotch block in this position fits a part of the outer circumference of the wheel up a certain height. The scotch block is formed by two distinct parts, namely a lower part and an upper part, the lower part being fixed rigidly to the rail and the upper part being retractable from a high position to a low position and vice-versa by rotation about an axis. Movement from the low position to the high position is controlled by an operating component situated upstream from and immediately adjacent the lower part of the scotch block, which component is actuated by a front wheel of the vehicle.

3 Claims, 4 Drawing Figures

STOP DEVICE FOR STOPPING A WHEELED VEHICLE

FIELD OF THE INVENTION

The invention relates to a stop device for stopping a wheeled vehicle which runs on a guide rail, said device comprising a scotch block connected to the rail, against which scotch block the leading wheel of the vehicle can strike, said scotch block in this position fitting a part of the outer circumference of said wheel up a certain height.

BACKGROUND OF THE INVENTION

Such devices exist and are necessary at the end of a track in maintenance workshops and repair workshops, sidings, etc., for vehicles running on guide rails such as railway lines, for example.

These devices are not designed to stop vehicles running at high speed, but are provided for safety purposes to bring finally to a standstill vehicles which should normally stop before striking the device but which may, however, strike it at low speed, for example at the most a few km/h, due to the inaccuracy of the operator's driving.

Despite the low speed at which the vehicle is liable to strike the device, the kinetic energy of the moving unit is, however, very great because of the mass of the train. The device must therefore be strong and the scotch block must be high enough to prevent the vehicle wheel from passing over it. The normal necessary height is about fifteen centimeters.

However, it can happen that the base of the vehicle body is not as high as the required height above the rail, and is, say, six centimeters. That is a 6-centimeter scotch block is not high enough.

SUMMARY OF THE INVENTION

The present invention aims to mitigate this drawback by providing a scotch block formed in two distinct parts, namely a lower part and an upper part. The lower part is fixed rigidly to the rail and the upper part is retractable from a high position to a low position and vice-versa by rotation about an axis. Movement from the low position to the high position is controlled by control means which comprise an operating component situated upstream from and immediately adjacent the lower part of the scotch block, which component is actuated by a front wheel of the vehicle.

According to a particular embodiment of the invention, said control means comprise a crank arm one of whose ends is connected to the axis of rotation of the upper part of the scotch block and whose other end includes an oblong slot in which is articulated the end of a first arm of a lever of the first type which comprises a fixed axle. The second lever arm of which acts as an operating component and is free.

According to an optional characteristic of the invention, when at rest, said operating component forms an acute angle with the guide rail and extends above the level of the rail and is situated on the path of the front wheel of the vehicle.

According to one variant there is a countershaft which is fixed perpendicularly at the end of said operating component and extends over the rail.

The invention will be understood from the description of an embodiment given hereinbelow by way of example with reference to the accompanying drawings.

DESCRIPTION OF THE PREFERRED EMBODIMENT

Figure 1:
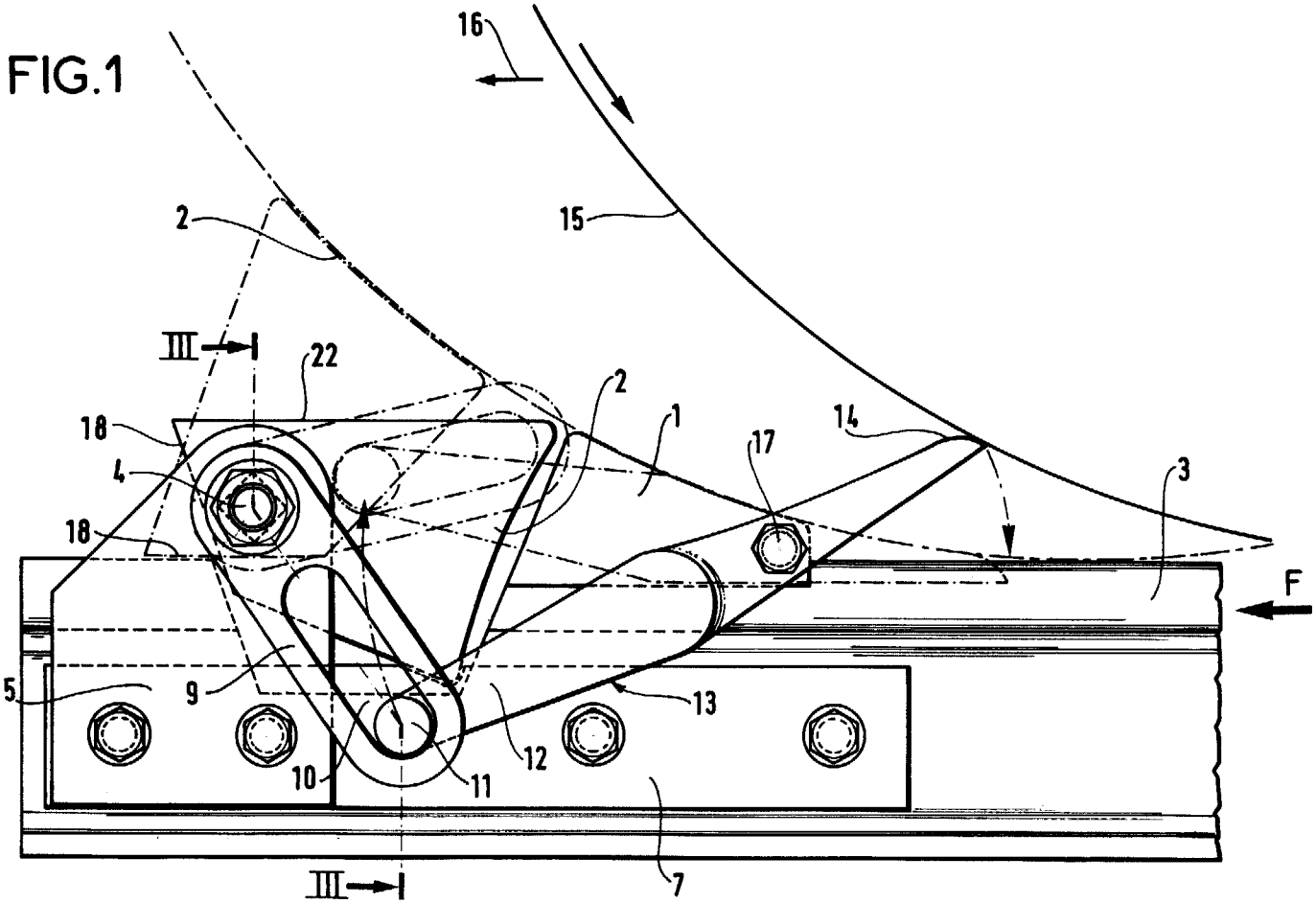
FIG. 1 is an elevational view of the device in accordance with the invention, applied to a vehicle which runs on a railway line.

The assembly illustrated in the figures includes a two part scotch block, comprising a lower part 1 and an upper part 2, both connected to a rail 3. The lower part 1 is rigidly connected to the rail 3 and fixed directly to it by any suitable means, e.g. by welding, and the upper part 2 is connected to the rail 3 but is free to pivot on the rail on an axle 4 integral with it. The axle 4 is carried by lateral cheeks 5 and 6 situated respectively on either side of the rail 3 and these cheeks are themselves fixed to the rail 3 by means of two fish-plates 7 and 8.

Figure 2:
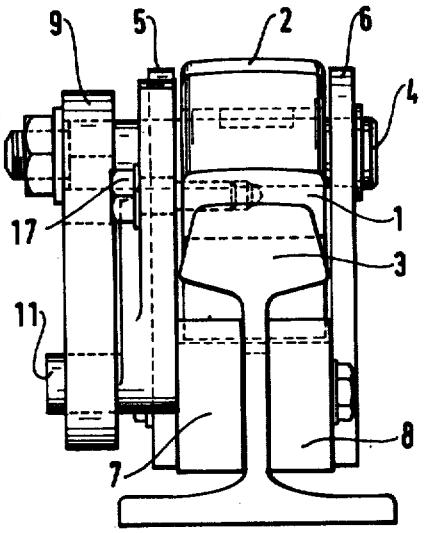
FIG. 2 is a right-hand end view in the direction of the arrow F of FIG. 1.
Figure 3:
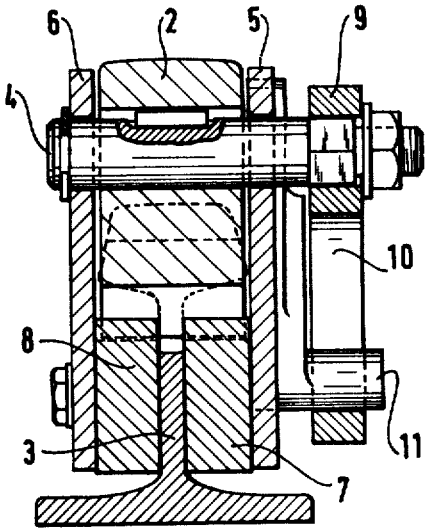
FIG. 3 is a left-hand vertical cross-sectional view taken along line III—III of FIG. 1.
Figure 4:
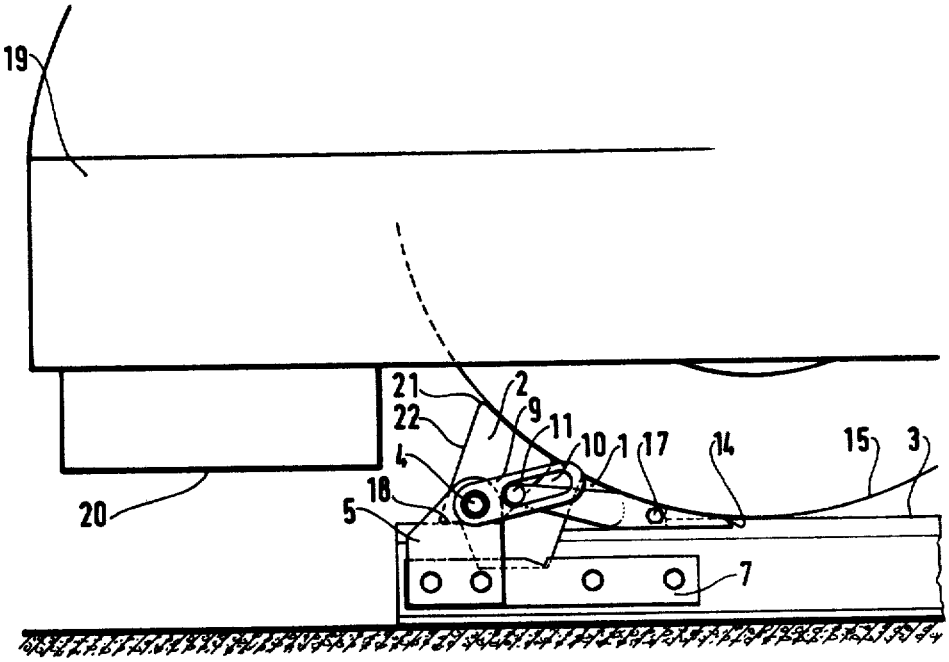
FIG. 4 is a schematic view of the device with a vehicle stopped against the scotch block.

The upper part 2 of the scotch block can assume two positions, namely, a high position shown in light chain-dotted lines in FIG. 1, the corresponding position of the control means described hereinbelow also being shown in chain-dotted lines, and a low or retracted position, shown, in FIG. 1, with its control means, in heavy unbroken lines. FIGS. 2 and 3 show the upper part 2 of the scotch block in the low retracted position. FIG. 4 shows the upper part 2 of the scotch block in the high position.

The means for controlling the movement of the upper part 2 of the scotch block comprise a crank arm 9 one of whose ends is integral with the pin 4 and whose other end has an oblong slot 10 in which is articulated the end 11 of an arm 12 of a lever 13 of the first type whose second arm 14 is free and acts as an operating component actuated by contact with the front wheel 15 of a vehicle advancing in the direction of the arrow 16. The lever 13 is pivoted at 17 at the base of the lower part 1 of the scotch block.

In the rest position, i.e. in the position shown in heavy unbroken lines in FIG. 1, the lever arm 14 forms an acute angle with the rail 3 and its end extends beyond the level of the rail.

When the vehicle advances in the direction of the arrow 16, the front wheel presses against the lever arm 14 which is far enough over to be situated on the path of the wheel. This raises the upper part 2 of the scotch block. If the width of the wheel is insufficient to press against the lever arm 14, a countershaft can be fixed to the end of the lever 14 perpendicular to the lever and passing over the rail 3.

As is seen in FIG. 1, when the assembly is in the high position, the upper part 2 of the scotch block, the lower part 1 thereof and the second lever arm 14, or operating component, fit the outer circumference of the wheel 15.

There is a break in the rails 3 to allow the upper part 2 of the scotch block to retract; likewise, the fish-plates 7 and 8 each have a notch if necessary. The limit of the up stroke of the upper part 2 of the scotch block depends on how hard its rear portion 18 presses against the upper surface of the rail 3.

FIG. 4 shows schematically a front wheel 15, and body 19 of a vehicle. The lower front part 20 of the body is at a lower level than the high level 21 of the scotch block in the high position. However, in the low position, the upper surface 22 of the upper part 2 of the scotch block is lower, for example by one centimeter, than the lower part 20 of the front of the vehicle body. Therefore it is seen that when the vehicle advances in the direction of the arrow 16 (FIG. 1), the lower part 20 of the vehicle body passes over the scotch block in the retracted position and only then is the scotch block raised by the wheel 15 to its high position to act as a stop for the vehicle.

The following dimensions are given by way of non-limiting example; they are heights in centimeters above the level of the rail 3:

lower part 20 of the vehicle body: 7 cm upper surface 22 of the upper part 2 of the scotch block in the retracted position:

upper part of the scotch block in the high position: 15 cm

Of course, the embodiment described is a particular example and without going beyond the scope of the invention, some features can be replaced by other equivalent features which fulfill the same technical function, e.g. the assembly technique, the substitution of a plurality of parts by a single molded part, etc.

I claim:

1. A stop device for stopping a wheeled vehicle which runs on a guide rail, said device comprising a scotch block mounted to the rail, for striking by the leading wheel of the vehicle to block passage of said vehicle, said scotch block in this position fitting a part of the outer circumference of said wheel at a certain height, the improvement wherein said scotch block is formed by a lower part and an upper part, said lower part being fixedly mounted to said rail, said upper part being mounted to said lower part for rotation about an axis and being retractable from a high position to a low position and vice-versa by rotation about said axis, and control means for effecting movement from the low position to the high position, said control means comprising an operating component situated upstream from and immediately adjacent the lower part of the scotch block, said operating component comprising a lever pivoted to said lower part and including a first free arm at one end positioned in the path of said wheel and a second arm articulated to the upper part of said scotch block for pivoting said upper part about said axis such that said operating component being in the path of movement of said front wheel is actuated upon contact of said first free arm by said front wheel of the vehicle.

2. A stop device according to claim 1, wherein said means further comprises a crank arm one of whose ends is connected to the axis of rotation of the upper part of the scotch block and whose other end includes an oblong slot, and wherein said lever comprises a fixed axle and the end of said second arm is articulated within said oblong slot.

3. A stop device according to claim 2, wherein, when at rest, said operating component forms an acute angle with the guide rail and extends above the level of the rail and is situated on the path of the front wheel of the vehicle.

* * * * *